US006271284B1

(12) United States Patent
Archibald et al.

(10) Patent No.: US 6,271,284 B1
(45) **Date of Patent: *Aug. 7, 2001**

(54) SLEEVES, THEIR PREPARATION, AND USE

(75) Inventors: James J. Archibald, Columbus; Matthew S. Sheridan, Powell, both of OH (US)

(73) Assignee: Ashland Inc., Dublin, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/638,565

(22) Filed: Aug. 14, 2000

Related U.S. Application Data

(63) Continuation of application No. 09/203,938, filed on Dec. 2, 1998, now abandoned, which is a continuation of application No. 08/811,395, filed on Mar. 4, 1997, now Pat. No. 5,880, 175.

(51) Int. Cl.[7] ..... B23C 1/22

(52) U.S. Cl. ..... 523/142; 523/139; 523/140; 523/141

(58) Field of Search ..... 523/139, 140, 523/141, 142

(56) References Cited

U.S. PATENT DOCUMENTS

| | | | |
|---|---|---|---|
| 3,485,797 | 12/1969 | Robins | 260/57 |
| 3,676,392 | 7/1972 | Robins | 260/38 |
| 4,051,092 | 9/1977 | Holik et al. | 260/29.3 |
| 4,518,723 | 5/1985 | Woodson | 523/466 |
| 4,526,219 | 7/1985 | Dunnavant et al. | 164/16 |
| 5,169,910 * | 12/1992 | Corley | 525/481 |
| 5,286,765 | 2/1994 | Franke et al. | 523/142 |
| 5,468,832 | 11/1995 | Schrader et al. | 528/53 |
| 5,880,175 * | 3/1999 | Archibald et al. | 523/142 |

FOREIGN PATENT DOCUMENTS

| | | |
|---|---|---|
| 0 769 338 A1 | 4/1997 | (EP) . |
| 2011432 | 1/1979 | (GB) . |

OTHER PUBLICATIONS

Koenig, T,; Hedden, G.; Koshida, K., *Nitrogen Radical Initiators*, Polym. Prepr., Amer. Chem. Soc., Div. Polym. Chem. (1970), 11(2), 826–32 (abstract).

Baines, F.C.; Grezlak, J.H.; Tobolsky, Arthur V., *Decompositions of Peroxycarbamates and their Initiation of Vinyl Polymerization*, J. Polym., Sci., Part A–1 (1969)m &(12., 3297–312, (abstract).

* cited by examiner

*Primary Examiner*—Tae H. Yoon
(74) *Attorney, Agent, or Firm*—David L. Hedden

(57) ABSTRACT

The subject invention relates to a foundry binder system which cures in the presence of a volatile amine curing catalyst comprising (a) an epoxy resin,(b) an organic polyisocyanate, (c) a reactive unsaturated acrylic monomer or polymer, and (d) an oxidizing agent. The foundry binders are used for making foundry mixes. The foundry mixes are used to make foundry shapes which are used to make metal castings.

11 Claims, No Drawings

SLEEVES, THEIR PREPARATION, AND USE

This application is a continuation, of application Ser. No. 09/203,938 filed on Dec. 2, 1998, now abandoned which is continuation application of Ser. No. 08/811,395 filed on Mar. 4, 1997 now U.S. Pat. No. 5,880,175.

FIELD OF THE INVENTION

The subject invention relates to a foundry binder system which cures in the presence of a volatile amine curing catalyst comprising (a) an epoxy resin,(b) an organic polyisocyanate, (c) a reactive unsaturated acrylic monomer or polymer, and (d) an oxidizing agent. The foundry binders are used for making foundry mixes. The foundry mixes are used to make foundry shapes which are used to make metal castings.

BACKGROUND OF THE INVENTION

One of the major processes used in the foundry industry for making metal parts is sand casting. In sand casting, disposable foundry shapes (usually characterized as molds and cores) are made by shaping and curing a foundry mix which is a mixture of sand and an organic or inorganic binder. The binder is used to strengthen the molds and cores.

The two major processes used in sand casting for making molds and cores are the (a) cold-box process and the (b) no-bake process. In the old-box process, a gaseous curing agent is passed through a compacted shaped mix to produce a cured mold and/or core. In the no-bake process, a liquid curing catalyst is mixed with the sand and shaped into a core or and/or mold.

The major cold-box process is based upon polyurethane-forming binders. See for example U.S. Pat. Nos. 3,409,579 and 3,676,392. These systems are cured with a gaseous tertiary amine catalyst. The polyurethane-forming binder system usually consists of a phenolic resin component and polyisocyanate component which are mixed with sand prior to compacting and curing to form a foundry mix.

When the two components of the polyurethane-forming binder system are mixed with the sand to form a foundry mix, they may prematurely react prior to curing with the gaseous catalyst. If this reaction occurs, it will reduce the flowability of the foundry mix when it is used for making molds and cores, and the resulting molds and cores will have reduced strengths. This reduced flowability and decrease in strength with time is related to the benchlife of the foundry mix.

Sufficient benchlife of the foundry mix is important to the commercial success of these binders. Benchlife is the time interval between forming the foundry mix and the time when the foundry mix is no longer useful for making acceptable molds and cores. A measure of the usefulness of the foundry mix and the acceptability of the molds and cores prepared with the foundry mix is the tensile strength of the molds and cores. If a foundry mix is used after the benchlife has expired, the resulting molds and cores will have unacceptable tensile strengths.

Because it is not always possible to use the foundry mix immediately after mixing, it is desirable to prepare foundry mixes with an extended bench life. When polyurethane-forming cold-box binders are used, generally a compound which improves the bench life of the foundry mix must be added to the binder, usually the polyisocyanate component of the binder.

Among the compounds useful to extend the bench life of the foundry mix are organic and/or inorganic phosphorus containing compounds. Examples of organic phosphorus-containing compounds used as benchlife extenders with polyurethane-forming binder systems are disclosed in U.S. Pat. No. 4,436,881 which discloses certain organic phosphorus containing compounds such as dichloroarylphosphine, chlorodiarylphosphine, arylphosphinic dichloride, or diarylphosphinyl chloride, and U.S. Pat. No. 4,683,252 which discloses organohalophosphates such as monophenyldichlorophosphate.

Examples of inorganic phosphorus-containing compounds which extend the bench life of polyurethane-forming binder systems are disclosed in U.S. Pat. No. 4,540,724 which discloses inorganic phosphorus halides such as phosphorus oxychloride, phosphorus trichloride, and phosphorus pentachloride, and U.S. Pat. No. 4,602,069 which discloses inorganic phosphorus acids such as orthophosphoric acid, phosphoric acid, hypophosphoric acid, metaphosphoric acid, pyrophosphoric acid, and polyphosphoric acid.

Carboxylic acids, such as citric acid, are also used to extend the benchlife of polyurethane-forming foundry binders. See U.S. Pat. No. 4,760,101.

As can be seen, there are numerous benchlife extenders for polyurethane-forming cold-box binders which reflects the interest in extending the benchlife of the foundry mix. Despite the cited work, there is still a need for amine-cured binder systems with longer benchlife.

SUMMARY OF THE INVENTION

The invention relates to a foundry binder system which will cure in the presence of a volatile amine curing catalyst comprising:

(a) from 5 to 80 weight percent of an epoxy resin;

(b) from 5 to 80 weight percent of an organic polyisocyanate;

(c) from 5 to 75 weight percent of a reactive unsaturated acrylic monomer or polymer; and (d) from 2 to 45 weight percent of an oxidizing agent, where (a), (b), (c), and (d) are separate components or can be mixed with another component, provided (b) or (c) is not mixed with (d), and where said weight percents are based upon the total weight of (a), (b), (c), and (d). Preferably, the weight percent of (a) is 20 to 40, the weight percent of (b) is 20 to 40, the weight percent of (c) is 15 to 40, and the weight percent of (d) is 5 to 15.

The foundry binders are used for making foundry mixes. The foundry mixes are used to make foundry shapes which are used to make metal castings. The foundry binder systems described herein have considerably longer benchlife than the previously cited phenolic urethane binders. The foundry mixes produce cores and molds with adequate tensile strengths for commercial use. Castings, made with an assembly of cores and/or molds made with the binders, are acceptable for commercial use. Additionally, the binder does not contain any free phenol or free formaldehyde, and has zero or low volatile organic compounds (VOC). The binders are not photochemically reactive and the used sand is reclaimable.

BEST MODE AND OTHER MODES OF PRACTICING THE INVENTION

The subject binder must contain an epoxy resin. The weight ratio of epoxy resin to organic polyisocyanate generally is from 1:10 to 10:1, preferably from 1:5 to 5:1, most preferably from 1:2 to 2:1.

For purposes of this disclosure, "epoxy resin" is defined as a thermosetting resin which contains more than one reactive epoxide group per molecule. Such resins have either a mixed aliphatic-aromatic or exclusively non-aromatic (i.e., aliphatic or cycloaliphatic) molecular structure. The mixed aliphatic-aromatic epoxy resins generally are prepared by the well-known reaction of a bis-(hydroxy-aromatic)alkane or a tetrakis- (hydroxy-aromatic) alkane with a halogen-substituted aliphatic epoxide in the presence of a base such as, for example, sodium hydroxide or potassium hydroxide. Examples of the halogen-substituted aliphatic epoxides include epichlorohydrin, 4-chloro-1,2-epoxybutane, 5-bromo-1,2-epoxypentane, 6-chloro-1,3-epoxyhexane and the like. In general, it is preferred to use a chloride substitute terminal denoting that the epoxide group is on the end of the alkyl chain.

The most widely used epoxy resins are diglycidyl ethers of bisphenol A. These are made by reaction of epichlorohydrin with bisphenol A in the presence of an alkaline catalyst. By controlling the operating conditions and varying the ratio epichlorohydrin to bisphenol A, products of different molecular weight can be made. Other epoxy resins include (a) the diglycidyl ethers of other bisphenol compounds such as bisphenol B, F, G, and H, (b) epoxy resins produced by reacting a novolac resin with a halogen-substituted aliphatic epoxide such as epichlorohydrin, 4-chloro-1,2-epoxybutane, 5-bromo-1,2-epoxypentane, 6-chloro-1,3-epoxyhexane and the like, (c) epoxidized polybutadiene resins, and (d) epoxidized drying oils.

Particularly preferred are epoxy resins with a weight per epoxy group of 175 to 200. Although the viscosities of the epoxy resins are high, usually greater than 5,000 cps at 25° C., the epoxy component viscosity is reduced to a workable level when the epoxy resin is mixed with the oxidizing agent. Useful epoxy resins are disclosed in U.S. Pat. No. 4,518,723 which is hereby incorporated by reference into this disclosure.

Oxidizing agents which are used in component (a) include peroxides, hydroperoxides, hydroxy hydroperoxides, ketones, peroxides, peroxy ester oxidizing agents, alkyl oxides, chlorates, perchlorates, chlorites, hydrochlorides, perbenzoates, permanganates, etc. Preferably, however, the oxidizing agent is a peroxide, hydroperoxide or a mixture of peroxide or hydroperoxide with hydrogen peroxide. The organic peroxides may be aromatic or alkyl peroxides. Examples of useful diacyl peroxides include benzoyl peroxide, lauroyl peroxide and decanoyl peroxide. Examples of alkyl peroxides include dicumyl peroxide and di-t-butyl peroxide. Hydroperoxides particularly preferred in the invention include t-butyl hydroperoxide, cumene hydroperoxide, paramenthane hydroperoxide, etc. Mixtures of one or more of the above organic peroxides or hydroperoxides can be utilized with hydrogen peroxide as curing or hardening agents or accelerators.

Although not necessarily preferred, the epoxy component (a), may contain an aromatic hydrocarbon solvent such as benzene, toluene, xylene, ethylbenzene, naphthalenes, mixtures thereof, and the like. If a solvent is used, sufficient solvent should be used so that the resulting viscosity of component (a) is less than 1,000 centipoise, preferably less than 300 centipoise. Generally, however, the total amount of aromatic hydrocarbon solvent is used in an amount of 0 to 25 weight percent based upon the total weight of the epoxy resin.

Although not necessarily preferred, a phenolic resin can be added to the epoxy component (a), preferably a polybenzylic ether phenolic resole resin. Polybenzylic ether phenolic resole resins are well known in the patent literature and are specifically described in U.S. Pat. No. 3,485,797 which is hereby incorporated by reference into this disclosure. They are prepared by reacting an aldehyde and a phenol in a mole ratio of aldehyde to phenol of at least 1:1, generally from 1.1:1.0 to 3.0:1.0 and preferably from 1.1:1.0 to 2.0:1.0, in the presence of a metal ion catalyst, preferably a divalent metal ion such as zinc, lead, manganese, copper, tin, magnesium, cobalt, calcium, or barium. If a polybenzylic ether phenolic resin is used, an appropriate solvent may be used with it. Appropriate solvents and their amounts are disclosed in U.S. Pat. No. 3,485,797 which was mentioned previously.

The organic polyisocyanate component of the binder system comprises an organic polyisocyanate having a functionality of two or more, preferably 2 to 5. It may be aliphatic, cycloaliphatic, aromatic, or a hybrid polyisocyanate. Mixtures of such polyisocyanates may be used. Representative examples of organic polyisocyanates are aliphatic polyisocyanates such as hexamethylene diisocyanate, alicyclic polyisocyanates such as 4,4'-dicyclohexylmethane diisocyanate, and aromatic polyisocyanates such as 2,4- and 2,6-toluene diisocyanate, diphenylmethane diisocyanate, and dimethyl derivatives thereof. Other examples of suitable organic polyisocyanates are 1,5-naphthalene diisocyanate, triphenylmethane triisocyanate, xylylene diisocyanate, and the methyl derivatives thereof, polymethylenepolyphenyl isocyanates, chlorophenylene-2,4-diisocyanate, and the like. The organic polyisocyanate is used in a liquid form. Solid or viscous polyisocyanates must be used in the form of organic solvent solutions, the solvent generally being present in a range of up to 80 percent by weight of the solution.

The acrylic component of the polyisocyanate component (b) is a reactive unsaturated acrylic monomer or polymer or mixtures thereof. Examples of such materials include a wide variety of monofunctional, difunctional, trifunctional and tetrafunctional acrylates. A representative listing of these monomers includes alkyl acrylates, hydroxyalkyl acrylates, alkoxyalkyl acrylates, acrylated epoxy resins, cyanoalkyl acrylates, alkyl methacrylates, hydroxyalkyl methacrylates, alkoxyalkyl methacrylates, cyanoalkyl methacrylates, N-alkoxymethylacrylamides, N-alkoxymethylmethacrylamides, and difunctional monomeric acrylates. Other acrylates which can be used include trimethylolpropane triacrylate, methacrylic acid and 2-ethylhexyl methacrylate.

Examples of unsaturated reactive polymers include epoxy acrylate reaction products, polyester/urethane/acrylate reaction products, polyether acrylates, and polyester acrylates. Unsaturated polymers include commercially available materials such as, acrylated urethane oligomers from Thiokol and CMD 1700, an acrylated ester of an acrylic polymer and CELRAD 2701, an acrylated epoxy resin both available from Celanese.

The weight ratio of organic polyisocyanate to reactive unsaturated acrylic monomer or polymer generally is from 10:1 to 1:10, preferably from 1:5 to 5:1.

Although solvents are not required for the organic polyisocyanate component, typical solvents which can be used are generally those which have been classified in the art as coupling solvents and include furfural, furfuryl alcohol, Cellosolve acetate, butyl Cellosolve, butyl Carbitol, diacetone alcohol, and Texanol. Other polar solvents include liquid dialkyl esters such as dialkyl phthalate of the type disclosed in U.S. Pat. No. 3,905,934 and other dialkyl esters such as dimethyl glutarate. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C.

Drying oils, for example those disclosed in U.S. Pat. No. 4,268,425, may also be used in the polyisocyanate component. Drying oils may be synthetic or natural occurring and include glycerides of fatty acids which contain two or more double bonds whereby oxygen on exposure to air can be absorbed to give peroxides which catalyze the polymerization of the unsaturated portions.

The addition of free radical scavengers or inhibitors such as benzoquinone is useful in improving the benchlife of foundry mixes made with the binder system. Benzoquinone acts as an free radical inhibitor/scavenger to inhibit the premature cure of the foundry binder system. Representative examples of inhibitors/retarders include but is not limited to 4-methoxyphenol, hydroquinone, t-butylcatechol, pyrogallol, nitrobenzene, 1,3,5 trinitrobenzene, chloranil, aniline, phenol, etc. The amount of benzoquinone used is generally from 0 to 3 weight percent, preferably 0 to 1 weight percent based upon the total weight of the binder. The benzoquinone may be incorporated into either the epoxy component (a) or the polyisocyanate component (b), or both.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used is known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Although the aggregate employed is preferably dry, small amounts of moisture, generally up to about 1 weight percent based on the weight of the sand, can be tolerated. This is particularly true if the solvent employed is non-water-miscible or if an excess of the polyisocyanate necessary for curing is employed since such excess polyisocyanate will react with the water.

It will be apparent to those skilled in the art that other additives such as silanes, silicones, bench life extenders, release agents, defoamers, wetting agents, etc. can be added to the aggregate, or foundry mix. The particular additives chosen will depend upon the specific purposes of the formulator.

The foundry mix is molded into the desired shape and whereupon it is cured by the cold-box process. Curing by the cold-box process is carried out by contacting the foundry shape with a gaseous tertiary amine as described in U.S. Pat. No. 3,409,579 which is hereby incorporated into this disclosure by reference.

EXAMPLES

The examples will illustrate specific embodiments of the invention. These examples along with the written description will enable one skilled in the art to practice the invention. It is contemplated that many other embodiments of the invention will be operable besides these specifically disclosed. All parts are by weight and all temperatures are in ° C. unless otherwise specified. The examples set forth describe various embodiments of the invention, but they are not intended to imply that other embodiments will not work effectively. The following abbreviations are used in the Examples:

| ABBREVIATIONS AND DEFINITIONS | |
|---|---|
| Epoxy resin DER 331 | epoxy resin DER 331, the epoxy resin used in the examples which is prepared by and sold commercially by Dow Chemical. |
| CHP | cumene hydroperoxide. |
| DMEA | N,N-dimethylethylamine gas as catalyst. |
| ISOCURE ® 305/605 binder | a polyurethane cold-box binder cured with DMEA, sold by Ashland Chemical Company. |
| Mondur MR | organic polyisocyanate sold by Bayer AG. |
| TMPTA | trimethylolpropane triacrylate. |

In order to carry out the examples, the Part I was first mixed with sand and then the Part II was added. The polyisocyanate component used in the examples was a polymethylene polyphenyl isocyanate (MONDUR MR sold by BAYER AG).

The resulting foundry mixes were compacted into a dogbone shaped core box by blowing and were cured using the cold-box process as described in U.S. Pat. No. 3,409,579. In this instance, the compacted mixes were then contacted with a mixture of N,N-dimethylethylamine (DMEA) gas in nitrogen at 20 psi for 3.0 seconds, followed by purging with 60 psi nitrogen for about 6 seconds, thereby forming AFS tensile test specimens (dog bones) using the standard AFS procedure.

Measuring the tensile strength of the dog bone shapes enables one to predict how the mixture of sand and binder will work in actual foundry operations. Lower tensile strengths for the shapes after extended benchlife indicate that the binder components reacted more extensively after mixing with the sand prior to curing with amine gas.

In the examples which follow, dog bone samples were formed from the foundry mix immediately after mixing (zero bench), three hours after mixing (three hour benchlife), five hours after mixing (five hour benchlife), and 24 hours after mixing (24 hour benchlife). Then tensile strengths of the various cured samples were measured immediately (IMM) and 24 hours after curing. Some of the dog bone samples that were formed from freshly prepared (zero bench) foundry mixes were stored for 24 hours at a relative humidity (RH) of 90% and a temperature of 25° C. before measurement of the tensile strength. The test conditions are set forth in Table I. The components used in examples 1–2 are specified in Table II, and the tensile strengths of the dog bone samples prepared with the formulations of examples 1–2 are given in the Table III.

TABLE I

| TEST CONDITIONS | |
|---|---|
| Sand | 4000 g Manley IL5W at about 25° C. |
| CT[1] Room | 50% Relative Humidity, 25° C. |
| Sand Lab | 33% Relative Humidity, 22° C. |
| Part A/Part B weight ratio | 37/63 |
| Binder level (bos) | 1.75% |
| Catalyst | DMEA |
| Gas time (seconds) | 3.0 |
| Purge time (seconds) | 7.0 (Ambient Air) |

[1]CT = constant temperature room.

TABLE II

| PART A AND PART B BINDER FORMULATIONS | | | | |
|---|---|---|---|---|
| | PART A | | PART B | |
| EXAMPLE | DER 331 | CHP | MONDUR MR | TMPTA |
| 1 | 75.7 | 24.3 | 62.8 | 37.2 |
| 2 | 84.0 | 16.0 | 60.0 | 30.0[2] |

[2]Formulation 2 also contained 10% by weight of an acrylic ester of bisphenol A epoxy in the Part II component of the binder.

TABLE III

| (TENSILE STRENGTH IN PSI) | | | | | | | |
|---|---|---|---|---|---|---|---|
| | ZERO BENCHLIFE | | | THREE HR BENCHLIFE | | 24 HR BENCHLIFE | |
| EXAMPLE | IMM | 24 HR | 24 HR @ 90% RH | IMM | 24 HR | IMM | 24 HR |
| 1 | 109 | 188 | 57 | 139 | 165 | 82 | 120 |
| 2 | 98 | 248 | 118 | 104 | 221 | 61 | 129 |

Example 1 and 2 are the same except the levels of the components were varied in the Part A and Part B. Examples 1–2 illustrate that the subject binders can be used for at least 24 hours to make dogbones samples with adequate tensile strengths without the use of a benchlife extender.

A comparison test was conducted to compare the benchlife of a binder within the scope of this invention to ISOCURE® LF 305/605 binder, a commercial phenolic urethane binder available from Ashland Chemical Company which contains an organophosphorous compound as a benchlife extender. The test conditions are the same as given in Table I except benzoquinone has been added in formulation 4 to increase bench life even further. The formulations and results are shown in Table IV.

TABLE IV

| (TENSILE STRENGTH IN PSI) | | | | | | | | | |
|---|---|---|---|---|---|---|---|---|---|
| | PART A | | | PART B | | 5 HR BENCHLIFE | | 24 HR BENCHLIFE | |
| EXAMPLE | DER 331 | CHP | BZQ | MONDUR MR | TMPTA | IMM | 24 HR | IMM | 24 HR |
| ISOCURE | — | — | — | — | — | 74 | 157 | 0 | 0 |
| 3 | 75.5 | 24.5 | 0.0 | 49.8 | 50.2 | 96 | 171 | 44 | 75 |
| 4 | 75.5 | 24.3 | 0.2 | 49.8 | 50.2 | 122 | 210 | 90 | 123 |

The results in Table IV indicate that the foundry mixes prepared with the binders of Examples 3 and 4 have much better benchlife than the ISOCURE binder, and that benchlife of the subject binder is further improved if benzquinone is added to the binder.

Castings were also made from 319 aluminum using a sand core made with the binder of formulation of Example 1 and ISOCURE 305/605 binder. The test conditions are shown in Table V below and the results are shown in Table VI. The data indicate that the casting quality of the binders of this invention are comparable to that of ISOCURE and that the binders of this invention are excellent for the casting of aluminum.

TABLE V

| CONDITIONS FOR CASTING ALUMINUM | |
|---|---|
| Pouring Temp. | 705° C. |
| Sand | Wedron 540 |
| Binder Level | 1.75% B.O.S. |
| Comparative Binder | ISOCURE 305/605 |
| Formulation | Binder of Example 1 |

TABLE VI

| ALUMINUM CASTING RESULTS | | | | | |
|---|---|---|---|---|---|
| EXAMPLE | BINDER | EROSION RESISTANCE | PENETRATION RESISTANCE | SURFACE FINISH | VEINING RESISTANCE |
| Comparison | ISOCURE | 1.0 | 1.0 | 1.0 | 1.0 |
| 5 | EXAMPLE 1 | 1.0 | 1.0 | 1.0 | 1.0 |

Casting grade: 1=Excellent, 2=Good, 3=Fair, 4=Poor, 5=Very Poor.

We claim:

1. A foundry binder system consisting essentially of:

(a) from 5 to 80 weight percent of an epoxy resin;

(b) from 5 to 80 weight percent of an organic polyisocyanate;

(c) from 5 to 75 weight percent of a reactive unsaturated acrylic monomer or polymer; and (d) an effective amount of an oxidizing agent comprising a hydroperoxide, where (a), (b), (c), and (d) are separate components or mixed with another of said components, provided (b) or (c) is not mixed with (d), where said weight percents are based upon the total weight of (a), (b), (c), and (d), and where said binder cures by a cold-box process in the presence of a volatile aliphatic amine curing catalyst.

2. The foundry binder system of claim 1 wherein the weight percent of (a) is 20 to 40, the weight percent of (b) is 20 to 40, the weight percent of (c) is 15 to 40, and the weight percent of (d) is 5 to 15.

3. The foundry binder system of claim 2 wherein the weight ratio of organic polyisocyanate to reactive unsaturated acrylic monomer or polymer is from 1:5 to 5:1.

4. The foundry binder system of claim 3 wherein the reactive unsaturated acrylic monomer or polymer is a monomer and the monomer is trimethylolpropane triacrylate.

5. The foundry binder system of claim 4 wherein the oxidizing agent is a mixture of a hydroperoxide, and an oxidizing agent selected from the group consisting of peroxides ketone peroxides, and mixtures thereof.

6. The foundry binder system of claim 5 wherein the epoxy resin is selected from the group consisting of epoxy resins formed from a diglycidyl ether of bisphenol A, bisphenol F, epoxy novolak resins and mixtures thereof, and said hydroperoxide is cumene hydroperoxide.

7. The foundry binder system of claim 6 wherein the epoxy resin component also contains a free radical scavenger.

8. The foundry binder system of claim 7 wherein the free radical scavenger is benzoquinone.

9. The foundry binder system of claim 8 wherein the weight ratio of organic polyisocyanate to reactive unsaturated acrylic monomer or polymer is from 1:2 to 2:1.

10. A foundry mix comprising:

(a) a major amount of foundry aggregate; and (b) an effective bonding amount of the foundry binder system of claim 2, 3, 4, 5, 6, 7, 8, or 9.

11. The foundry binder system of claim 6 wherein said foundry binder system also includes a polybenzylic ether phenolic resole resin, provided said polybenzylic ether phenolic resole resin is not mixed with component (b).

* * * * *

UNITED STATES PATENT AND TRADEMARK OFFICE

CERTIFICATE OF CORRECTION

PATENT NO. : 6,271,284 B1 
DATED : August 7, 2001
INVENTOR(S) : James J. Archibald and Matthew S. Sheridan It is certified that error appears in the above-identified patent and that said Letters Patent is hereby corrected as shown below:

Title page, Item [54] and Column 1, line 1,
Delete the title, "SLEEVES, THEIR PREPARATION, AND USE", and replace it with -- AMINE CURED FOUNDRY BINDER SYSTEMS AND THEIR USES --.

Signed and Sealed this

Eighth Day of April, 2003

JAMES E. ROGAN
*Director of the United States Patent and Trademark Office*